US008191393B2

(12) United States Patent
Kraft

(10) Patent No.: US 8,191,393 B2
(45) Date of Patent: Jun. 5, 2012

(54) MICRO-CHANNEL TUBES AND APPARATUS AND METHOD FOR FORMING MICRO-CHANNEL TUBES

(75) Inventor: Frank F. Kraft, Albany, OH (US)

(73) Assignee: Ohio University, Athens, OH (US)

( * ) Notice: Subject to any disclaimer, the term of this patent is extended or adjusted under 35 U.S.C. 154(b) by 428 days.

(21) Appl. No.: 12/517,484

(22) PCT Filed: Dec. 11, 2007

(86) PCT No.: PCT/US2007/025438

§ 371 (c)(1),
(2), (4) Date: Jun. 3, 2009

(87) PCT Pub. No.: WO2008/073473

PCT Pub. Date: Jun. 19, 2008

(65) Prior Publication Data

US 2010/0064756 A1 Mar. 18, 2010

Related U.S. Application Data

(60) Provisional application No. 60/869,522, filed on Dec. 11, 2006.

(51) Int. Cl.
*B21C 23/04* (2006.01)

(52) U.S. Cl. ..... 72/264; 72/268; 72/269

(58) Field of Classification Search ..... 72/253.1, 72/258, 259, 261, 262, 264, 265, 266, 268, 72/269, 363, 700

See application file for complete search history.

(56) References Cited

U.S. PATENT DOCUMENTS

| | | | | | |
|---|---|---|---|---|---|
| 124,568 | A | * | 3/1872 | Granniss | 72/258 |
| 867,658 | A | * | 10/1907 | Hoopes et al. | 72/259 |
| 1,370,328 | A | * | 3/1921 | Lowe | 72/259 |
| 1,741,813 | A | * | 12/1929 | Boynton | 72/261 |
| 3,347,079 | A | * | 10/1967 | Rowell | 72/264 |
| 3,786,665 | A | * | 1/1974 | Creuzet | 72/259 |
| 4,208,898 | A | * | 6/1980 | Ames et al. | 72/258 |
| 4,703,642 | A | | 11/1987 | Wagner et al. | |

FOREIGN PATENT DOCUMENTS

| | | | |
|---|---|---|---|
| JP | 01 284423 | A | 11/1989 |
| JP | 07 060340 | A | 3/1995 |
| RU | 2 218 223 | C2 | 12/2003 |
| WO | 01/96039 | A1 | 12/2001 |
| WO | 03/035293 | A1 | 5/2003 |
| WO | 2008/073473 | A1 | 6/2008 |

OTHER PUBLICATIONS

European Examination Report dated Jul. 21, 2010; 4 pages.
International Preliminary Report on Patentability; Jun. 16, 2009; 8 pages.
International Search Report for PCT/US2007/025438 (WO 2008/073473) mailed Mar. 27, 2008.

* cited by examiner

*Primary Examiner* — Edward Tolan
(74) *Attorney, Agent, or Firm* — Calfee, Halter & Griswold LLP

(57) ABSTRACT

An apparatus and method are provided for extruding a micro-channel tube (402) from a non-aluminum metal or alloy such as copper. The micro-channel tube is formed by simultaneously extruding two rectangular shaped billets (404; 406) to form a top portion of the micro-channel tube and a bottom portion of the micro-channel tube in parallel. The top and bottom portions are then joined during the extrusion process (e.g., within a die assembly) to form the micro-channel tube (402).

15 Claims, 10 Drawing Sheets

MICRO-CHANNEL TUBES AND APPARATUS AND METHOD FOR FORMING MICRO-CHANNEL TUBES

RELATED APPLICATION

The present application claims priority from, and any other benefit of, U.S. Provisional Patent Application No. 60/869,522 filed on Dec. 11, 2006, the entire disclosure of which is herein incorporated by reference.

FIELD

The invention relates generally to a heat exchanger and, more particularly, to micro-channel tubes used in a heat exchanger and an apparatus and method for making the micro-channel tubes.

BACKGROUND

Conventional high-performance, parallel-flow heat exchangers are fabricated from aluminum alloy components. At present, these heat exchangers are used primarily for automotive climate control systems. These heat exchangers use a flat, multi-channel tube known as a micro-channel tube due to its relatively small size. The micro-channel tubes are currently fabricated from aluminum alloys, primarily using direct hot extrusion through hollow dies. During the extrusion process, the aluminum must divide into two or more metal streams, and flow around a bridge (not shown) that supports a mandrel 100 (see FIG. 1). As shown in FIG. 1, the mandrel 100 incorporates weld chambers 102 in which the metal streams must rejoin to develop a solid-state weld and form continuous internal walls, thus creating the internal passages or channels.

As shown in FIG. 2, a typical condenser 200 for a vehicle climate control system (e.g., a vehicle-loaded condenser) includes an array of alternately stacked parallel aluminum micro-channel tubes 202 (e.g., from 20-50 tubes per condenser) and louvered fins 204. The aluminum micro-channel tubes 202 extend between and are connected to a pair of header tanks 206. Referring to FIG. 3, some aluminum micro-channel tubes 300, 302, 304 and 306 having varying cross-sections are shown. The header tanks 206 are often formed from cylindrical pipe. In the condenser 200, parallel flows of a fluid (e.g., a refrigerant) are established through the channels in the aluminum micro-channel tubes 202 between the header tanks 206. Heat transfer occurs between the refrigerant in the aluminum micro-channel tubes 202 and air flowing through the louvered fins and past the aluminum micro-channel tubes 202. Essentially all passenger vehicles produced with air-conditioning in North America, Europe and Japan use these heat exchangers in their vehicle climate control systems (i.e., the current R134a-refrigerant based systems).

The performance benefits of parallel-flow heat exchanger technology, as successfully implemented by the automotive industry, have begun to be recognized by the commercial and residential HVAC industry. These industries have historically been dominated by heat exchangers using round copper tubing. Nevertheless, interest currently exists in using parallel-flow heat exchangers in HVAC applications, wherein the heat exchangers are fabricated using the only currently suitable material, namely an aluminum alloy, to form aluminum micro-channel tubing in brazed assemblies. Moreover, R744 ($CO_2$) refrigerant based systems, currently under development in the automotive and refrigeration industries, impose more severe operating conditions on the "high-pressure side" components, such as the gas cooler and associated micro-channel tube, the compressor, an internal heat exchanger/accumulator and all associated connections. Specifically, typical maximum operating pressures and temperatures are 16 MPa and 180° C., respectively (48 MPa static pressure with a factor of safety of 3). Micro-channel tube, such as those shown in FIG. 3, is ideally suited to heat exchangers using this "environmentally-friendly" refrigerant.

It is generally held that an extrusion process (e.g., the direct hot extrusion process described above) is only suitable for materials "that can be easily deformed at normal extrusion temperatures" such as 1000, 3000 and 6000 series aluminum alloys. Extrusion loads are also higher for "hollow-die" extrusion as a result of the metal separation as it enters the die. As a result, the high flow stress and high hot-working temperature of copper and other metals and alloys have precluded them from being extruded with a hollow-die extrusion process.

Hot work tool steels (with or without a surface treatment such as nitriding) rapidly wear and, thus, are not practical as a suitable wear surface for the die components (i.e., a mandrel or plate). Therefore, these die components have been fabricated from Tungsten carbide/cobalt (WC/Co) metal matrix composites (MMCs). WC/Co MMCs can provide suitable wear resistance, however their low fracture toughness imposed limits on the design of the die components and breakage was not uncommon. Currently, some extruders use die components made from tool steel coated with hard thin-film coatings. The tool steel provides the necessary die strength and fracture toughness, while the hard thin-film coatings provide the necessary wear resistance at elevated temperatures, for the extrusion of aluminum micro-channel tubes.

Copper-based heat exchangers, and specifically copper micro-channel tube, would offer several advantages over aluminum micro-channel tube for the aforementioned applications, including better strength (i.e., resistance to deformation) and elevated-temperature strength, better corrosion performance, higher thermal conductivity, better joining characteristics, and the ability for easier field service repair. Thus, there is an unmet need for a viable process for manufacturing micro-channel tube using a non-aluminum metal or alloy, such as copper or a copper alloy.

SUMMARY

In view of the above, it is an exemplary aspect to provide a micro-channel tube formed from a non-aluminum metal or alloy. The non-aluminum metal or alloy includes copper and copper alloys.

It is another exemplary aspect to provide a micro-channel tube formed from a metal or alloy that has previously not been extruded into a multi-channel hollow flat tube profile, as in the case of the micro-channel tube, due to difficulties in extruding the profile. The metal or alloy includes copper, copper alloys, and other alloys that are preferably extruded at temperatures up to approximately 800° C. and are otherwise difficult to extrude, including some "hard" aluminum alloys. Hard aluminum alloys, for example, include 2000 and 7000 series alloys, which have additions primarily of copper and zinc, respectively.

It is still another exemplary aspect to provide an apparatus and a method for extruding a micro-channel tube formed from a non-aluminum metal or alloy.

It is yet another exemplary aspect to provide an apparatus and a method for extruding a micro-channel tube using two rectangular shaped billets. The rectangular billets have a shape that is similar to a shape of an intermediate product or part being extruded (i.e., a top half or a bottom half of a micro-channel tube) and/or a shape of a final product or part being extruded (i.e., the micro-channel tube).

It is an exemplary aspect to provide an apparatus and a method for extruding two or more billets simultaneously, wherein the separate billets are formed and consolidated in a die assembly to produce an extruded product or part. The product or part may be a micro-channel tube.

It is another exemplary aspect to provide an apparatus and a method for extruding two or more billets, in parallel through a corresponding number of separate chambers in an extrusion container, to produce a product or part having a hollow or semi-hollow extrusion profile. The extrusion can involve, for example, any suitable direct (i.e., movement of the billets relative to a fixed die) extrusion process.

It is yet another exemplary aspect to provide an apparatus and a method for extruding two or more billets simultaneously, wherein the billets are made of different materials (e.g., metals or alloys), such that an extruded product or part is comprised of the different materials. The extrusion can involve, for example, any suitable direct extrusion process.

BRIEF DESCRIPTION OF THE DRAWINGS

The above aspects and additional aspects, features and advantages will become readily apparent by describing in detail exemplary embodiments thereof with reference to the attached drawings, wherein like reference numerals denote like elements, and.

DETAILED DESCRIPTION

Figure 1:
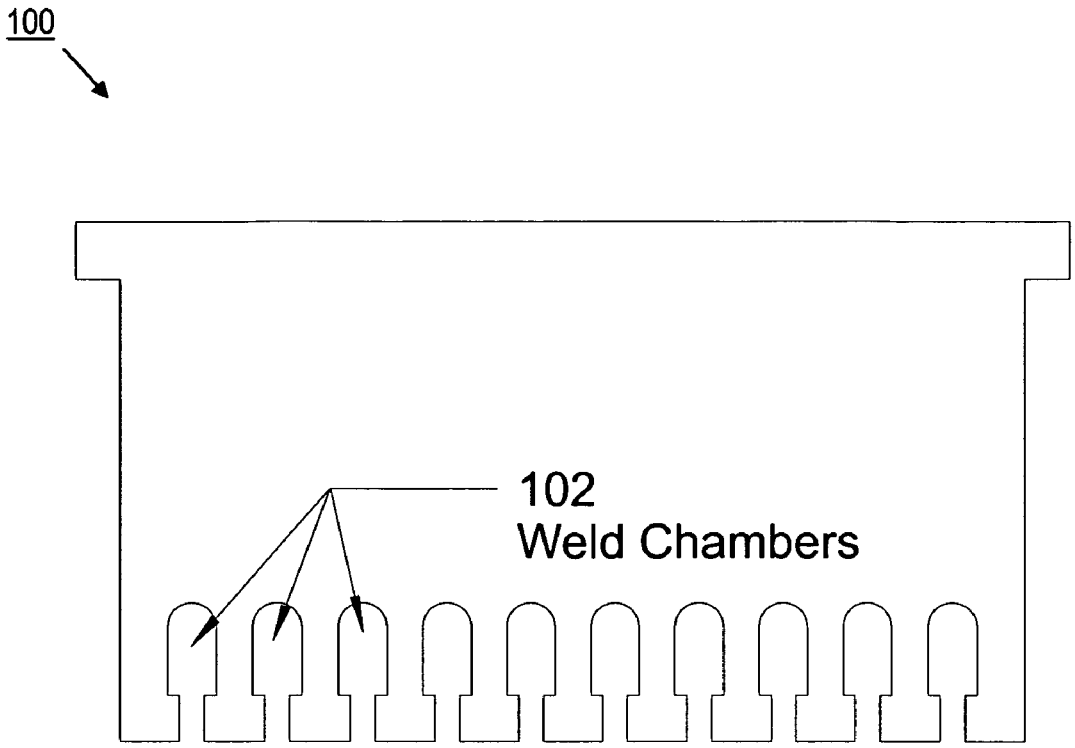
PRIOR ART FIG. 1
FIG. 1 is a diagram showing a conventional die mandrel that produces the internal surfaces of a micro-channel tube.
Figure 2:
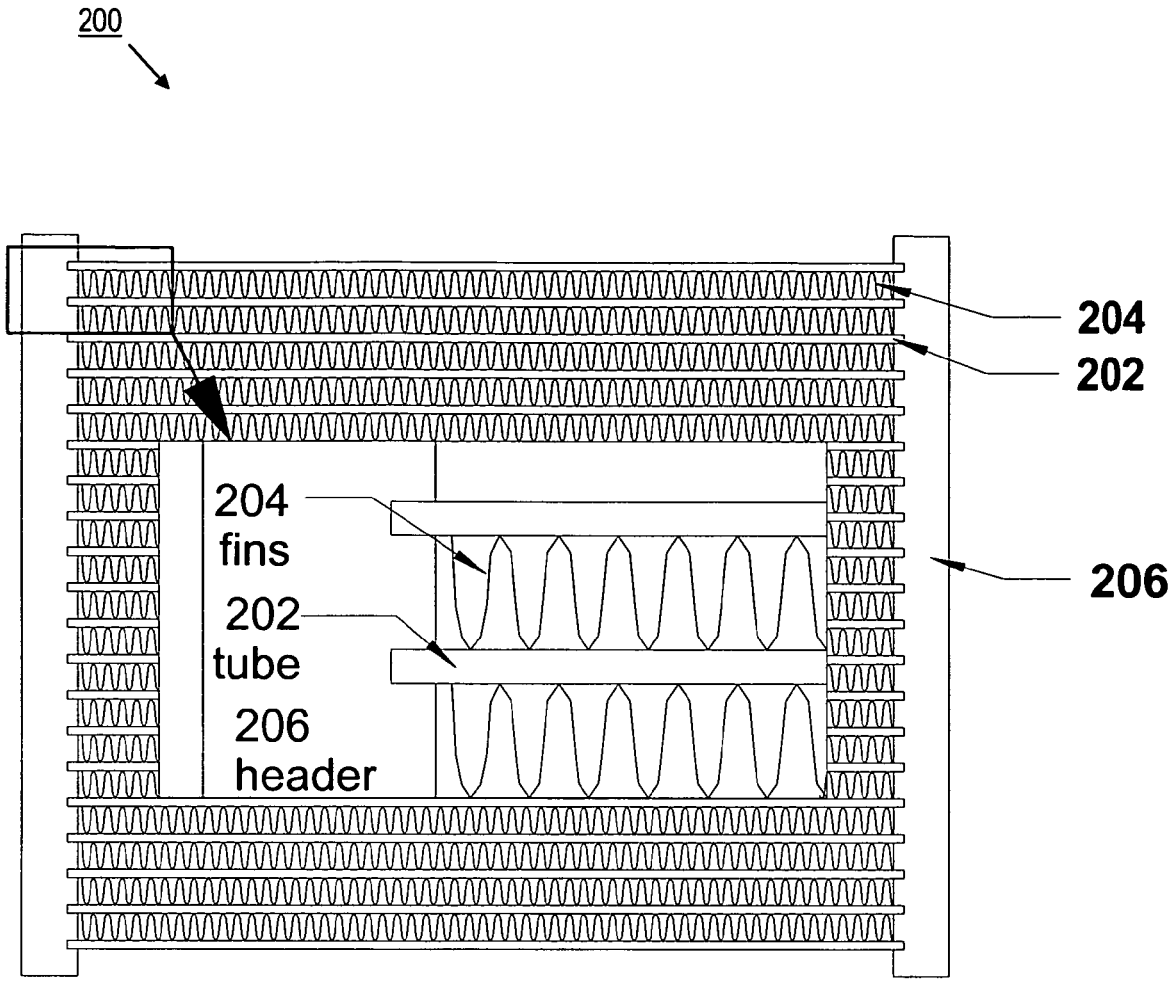
PRIOR ART FIG. 2
FIG. 2 is a diagram showing a conventional brazed, parallel-flow condenser (heat exchanger) for automotive climate control systems, wherein the inset provides a more detailed view showing the interfaces between aluminum micro-channel tubes, fins and a header.
Figure 3:
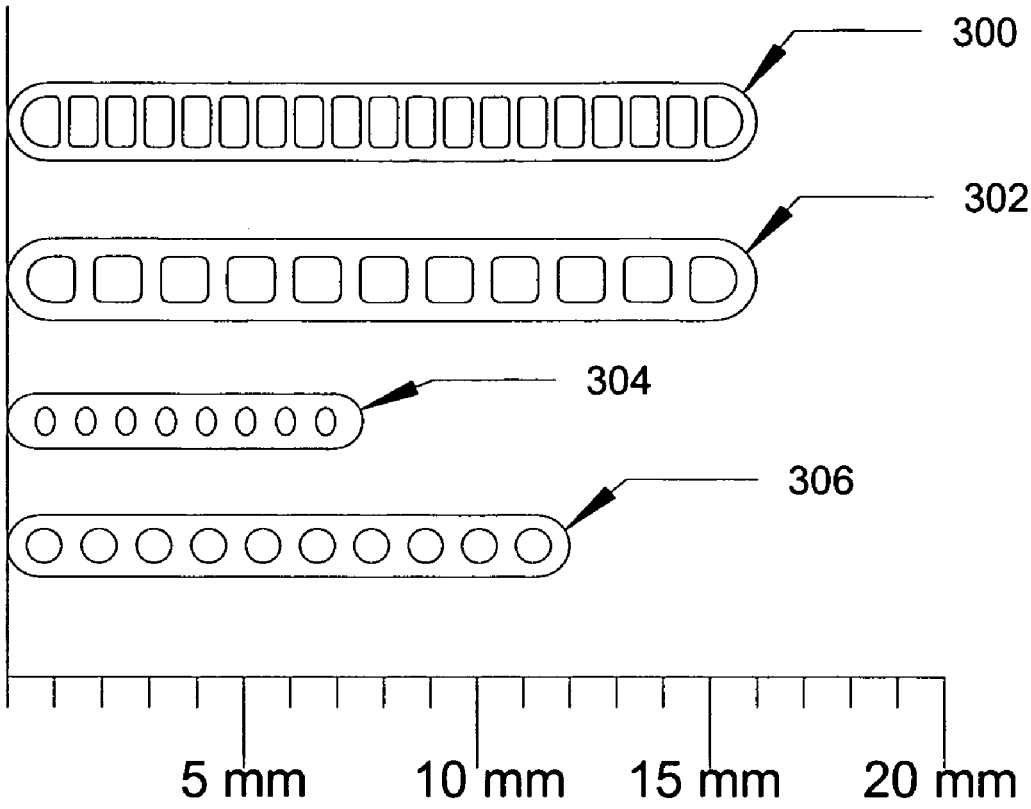
PRIOR ART FIG. 3
FIG. 3 is a diagram showing an assortment of conventional micro-channel tubes formed from the extrusion of aluminum alloys.

While the general inventive concept is susceptible of embodiment in many different forms, there are shown in the drawings and will be described herein in detail specific embodiments thereof with the understanding that the present disclosure is to be considered as an exemplification of the principles of the general inventive concept. Accordingly, the general inventive concept is not intended to be limited to the specific embodiments illustrated herein.

Figure 4:
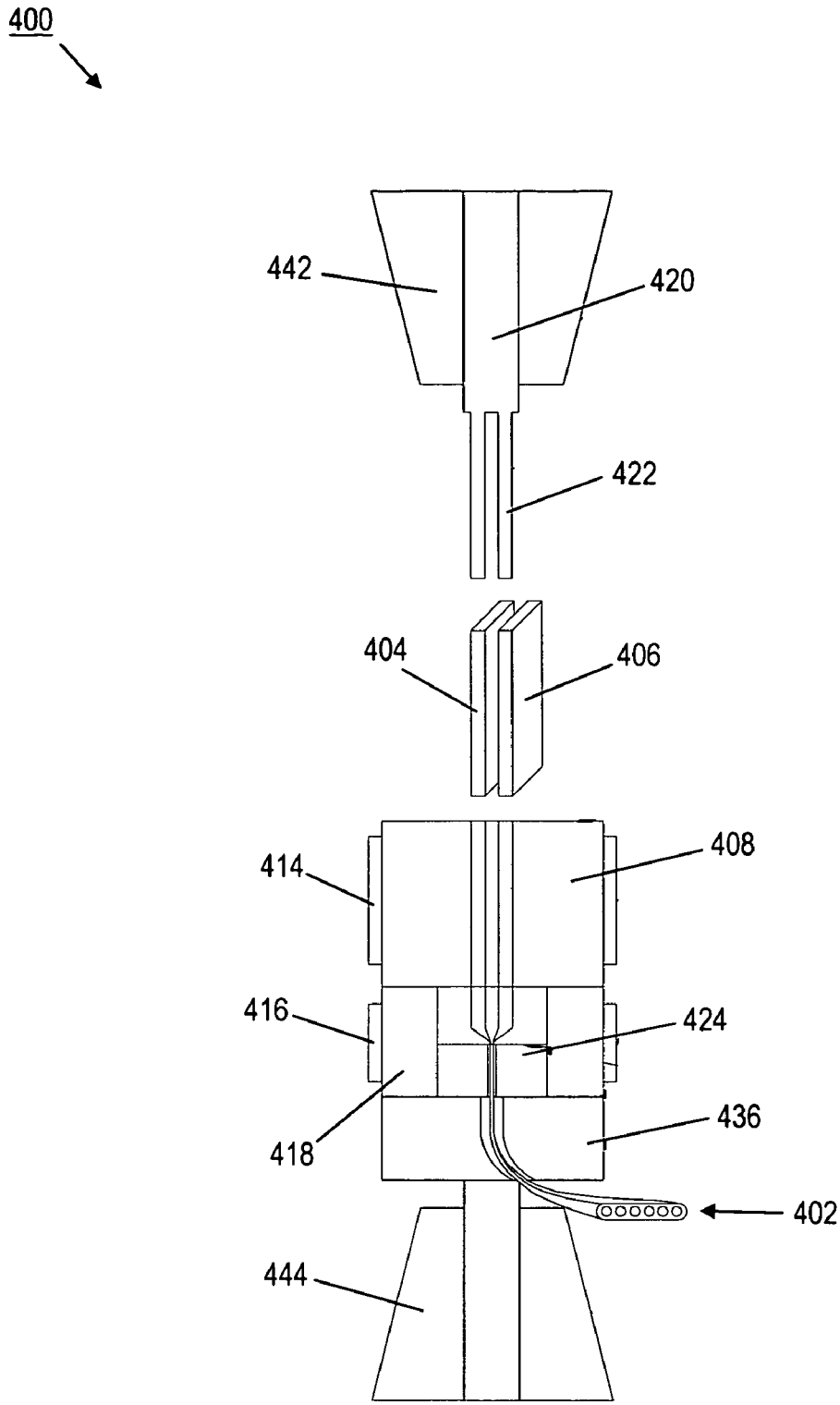
FIG. 4 is a diagram showing a direct hot extrusion apparatus, according to one exemplary embodiment, for producing micro-channel tubes extruded from a non-aluminum metal or alloy.

In one exemplary embodiment shown in FIG. 4, an apparatus 400 for producing a micro-channel tube 402 from a metal or alloy, using a modified hot extrusion process, is provided. In one exemplary embodiment, the metal or alloy is a non-aluminum metal or alloy, such as copper or a copper alloy (e.g., UNS C10100, which is an Oxygen-free electronic copper alloy). In one exemplary embodiment, the metal or alloy is any alloy that is extruded at temperatures up to approximately 800° C. and is otherwise difficult to extrude (e.g., a "hard" aluminum alloy). The apparatus 400 is operable to extrude two rectangular (in cross-section) billets 404, 406 in parallel, simultaneously through a two-chamber container 408 of the apparatus 400. In one exemplary embodiment, the billets 404, 406 are solid and formed, for example, from a hard aluminum alloy. A top billet 404 forms a top half 410 of the micro-channel tube 402 and a bottom billet 406 forms a bottom half 412 of the micro-channel tube 402, as schematically represented in FIG. 5.

Figure 5:
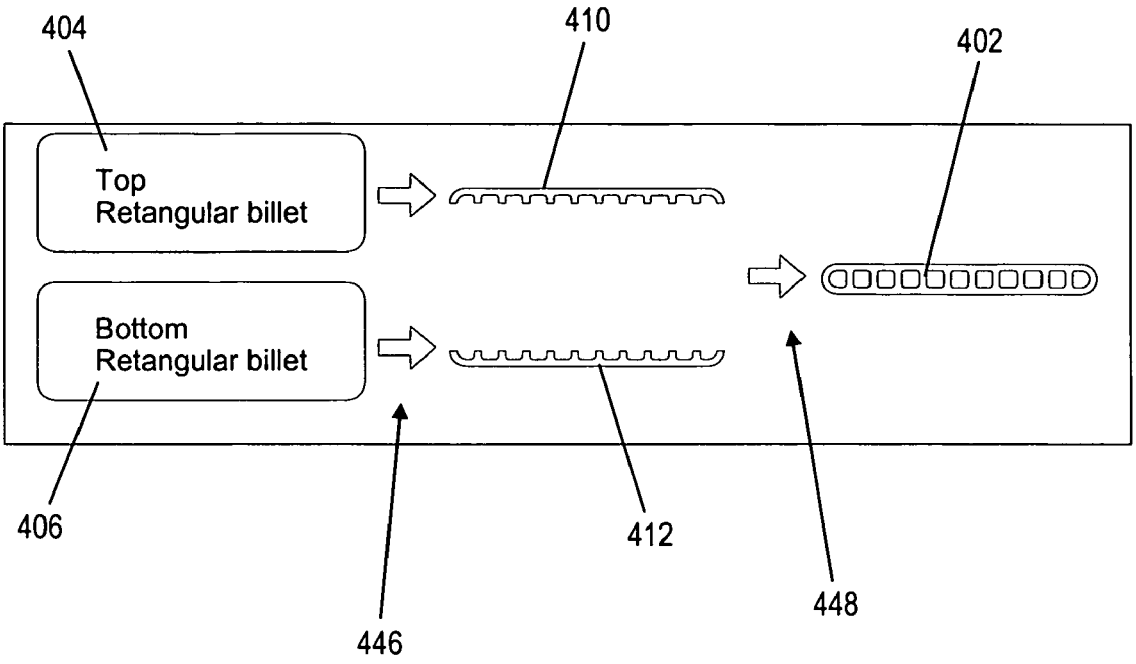
FIG. 5 is a diagram showing extrusion of a copper micro-channel tube from two separate rectangular billets using the apparatus of FIG. 4.

As shown in FIG. 5, the billets 404, 406 are forced into a deformation zone of the die assembly 424, as indicated by arrow 446. Accordingly, the billets 404, 406 form two separate flow streams, such that each billet 404, 406 produces approximately one-half of the micro-channel tube 402, i.e., a top half 410 and a bottom half 412 of the micro-channel tube 402. Solid state welds are then formed at a center of each portion of the internal walls 440 on the top half 410 and the bottom half 412 within the die assembly 424, as indicated by arrow 448. Once the solid state welds are formed, the unitary micro-channel tube 402 results.

Figure 6:
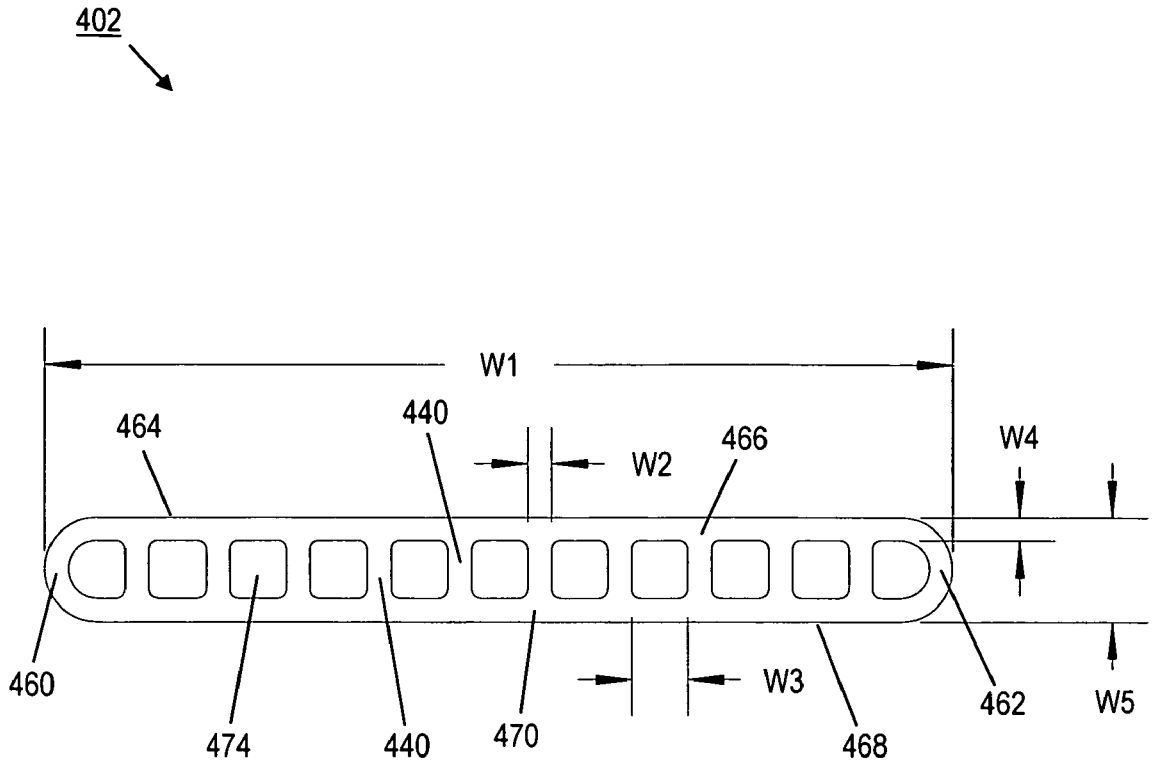
FIG. 6 is a diagram showing a widthwise cross-sectional view of a micro-channel tube, according to one exemplary embodiment.

A cross-sectional view of the micro-channel tube 402, according to one exemplary embodiment, is shown in FIG. 6. The micro-channel tube 402 has a width W1 extending between a first side wall 460 and a second side wall 462. The micro-channel tube 402 has a height W5 extending between a top surface 464 of a top wall 466 and a bottom surface 468 of a bottom wall 470. In one exemplary embodiment, a width W4 of the top wall 466 and the bottom wall 470 is the same. Internal walls 440 having a width W2 extend between the top wall 466 and the bottom wall 470 to form channels 474 of the micro-channel tube 402. In one exemplary embodiment, all of the channels 474 have the same width W3. In one exemplary embodiment, only some of the channels 474 have the same width W3.

In one exemplary embodiment, the micro-channel tube 402 has the following dimensions: a width W1 of approximately 16.00 mm, a width W2 of approximately 0.42 mm, a width W3 of approximately 1.00 mm, a width W4 of approximately 0.40 mm and a height W5 of approximately 1.80 mm. One of ordinary skill in the art will appreciate that the general inventive concept applies to micro-channel tubes of varying sizes, including those with widths smaller and/or larger than this exemplary embodiment.

Initially, the two billets 404, 406 are heated to an appropriate temperature (e.g., 700° C.-800° C.) for the extrusion of the micro-channel tube 402. For copper and copper alloy extrusion, an exemplary temperature range is 550° C.-1000° C. A general approximation of a suitable extrusion temperature range for a metal or an alloy would be about 60% of the absolute melting temperature of the metal or the alloy. The billets 404, 406 can be heated using any suitable means, such as a furnace. Thereafter, a fixture (not shown) transfers the billets 404, 406 for loading into the pre-heated two-chamber container 408. Referring to FIG. 4, in some embodiments, the apparatus 400 includes heaters 414 and 416 to pre-heat the container 408 and maintain an elevated temperature, thereby facilitating the extrusion of the micro-channel tube 402.

While the extrusion process may take place at approximately 800° C., alternate temperature values can range from 550° C.-1000° C. or 60% of the absolute melting temperature of the metal or alloy being extruded, tooling pre-heat temperatures can be significantly lower, such as around 500° C., or up to the temperature of the billets 404, 406. Thus, in some embodiments, an extrusion temperature range is between 600° C.-800° C. or 60% of the absolute melting temperature of the metal or alloy being extruded due to heat losses. By way of example, the container 408 and a die holder 418 are heated with band or cartridge heaters (as heaters 414, 416), and digital temperature controllers (not shown) are used to maintain their temperatures at a desired level (e.g., 500° C. or higher).

Figure 8A:
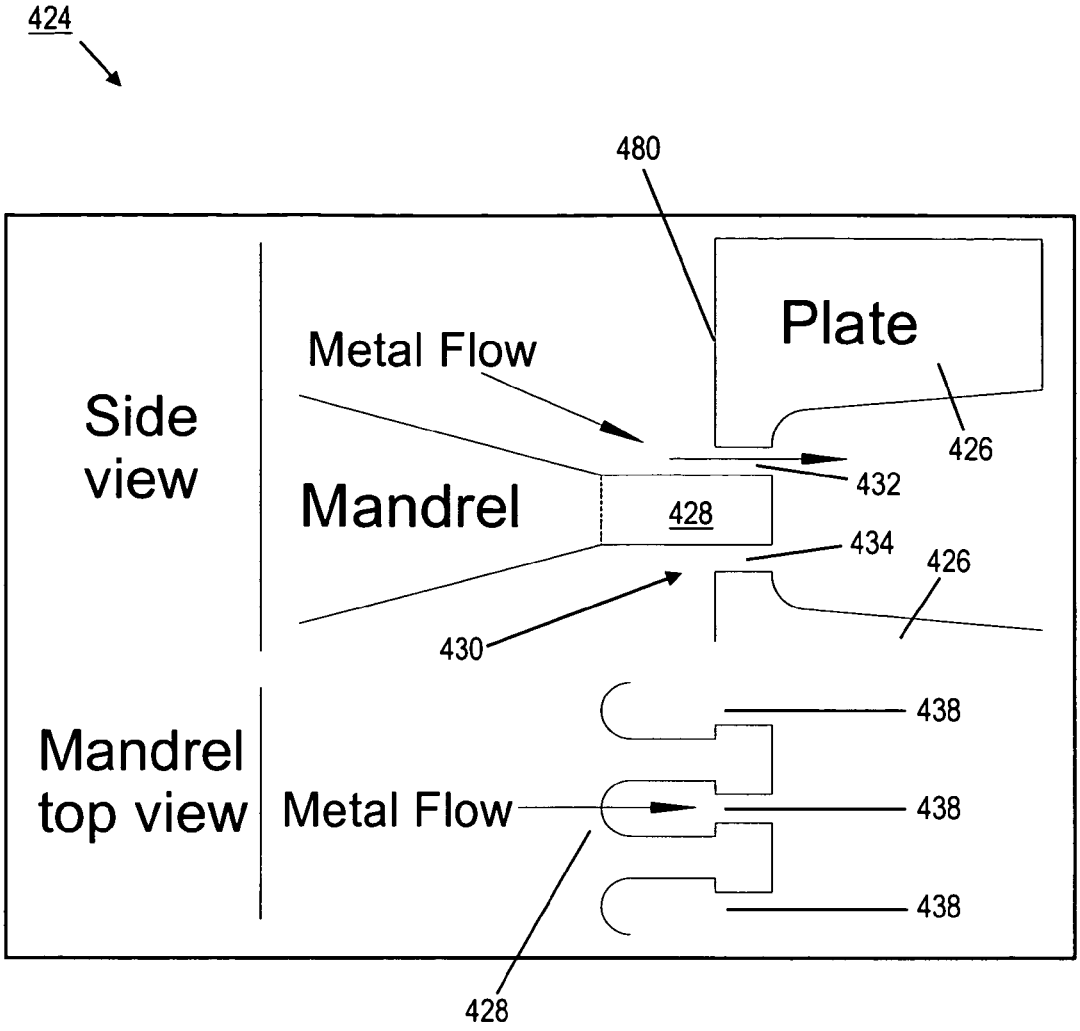
FIG. 8A is a diagram showing views of an exemplary die assembly in which a plate and mandrel are of a shear-edge design, such as used with aluminum extrusion.
Figure 8B:
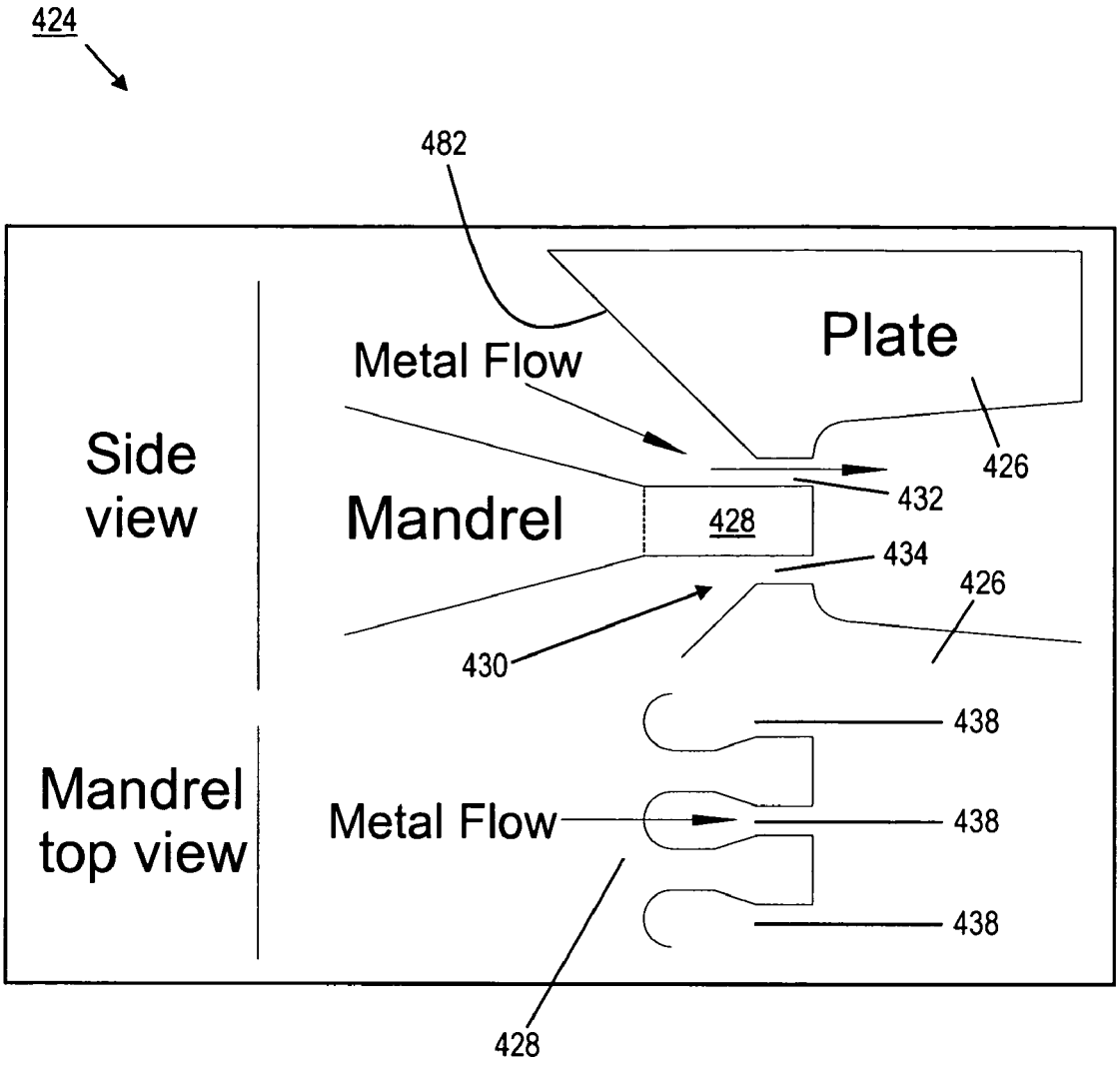
FIG. 8B is a diagram showing views of an exemplary die assembly in which a plate and mandrel are of a shaped design.

According to the embodiment shown in FIG. 4, a ram 420 includes a dual stem 422 that applies pressure to the billets 404, 406 and pushes them into the container 408. The mode of operation may be ram (stroke) control, wherein a velocity of the ram 420 or its position is specified or controlled with respect to time. The dual stem 422 is able to simultaneously provide pressure to each of the billets 404, 406. Under this pressure, the billets 404, 406 are crushed against a die assembly 424 of the apparatus 400. Two embodiments of the die assembly 424 are shown in FIGS. 8A and 8B. The die assembly 424 includes a plate 426 and a mandrel 428 extending through an opening 430 in the plate 426, thereby forming an opening 432 on one side of the mandrel 428 and an opening 434 on the other side of the mandrel 428. The apparatus 400 includes the die holder 418 and other supporting structure 436 (e.g., a backer, a bolster and a platen), which provide the necessary support for the die assembly 424 and the extruded multi-channel tube 402 during the extrusion process.

As a result of the applied heat and pressure, the softened metal of the billets 404, 406 is squeezed through corresponding openings 432, 434 in the die assembly 424 (see FIGS. 8A and 8B). As the billets 404, 406 deform in the die assembly 424, new "clean" un-oxidized surface area is generated in the metal flow streams. Thereafter, these clean metal surfaces of the two metal streams corresponding to the two extruded billets 404, 406 (i.e., the top half 410 of the micro-channel tube 402 and the bottom half 412 of the micro-channel tube 402) are forced together in weld chambers 438 of the mandrel 428 (from the existing pressure in the die assembly) to produce solid-state welds, thereby forming continuous internal walls 440 of the micro-channel tube 402 as depicted in FIG. 5. The mandrel 428 is fixed relative to the corresponding openings 432, 434 in the die assembly 424.

Figure 7:
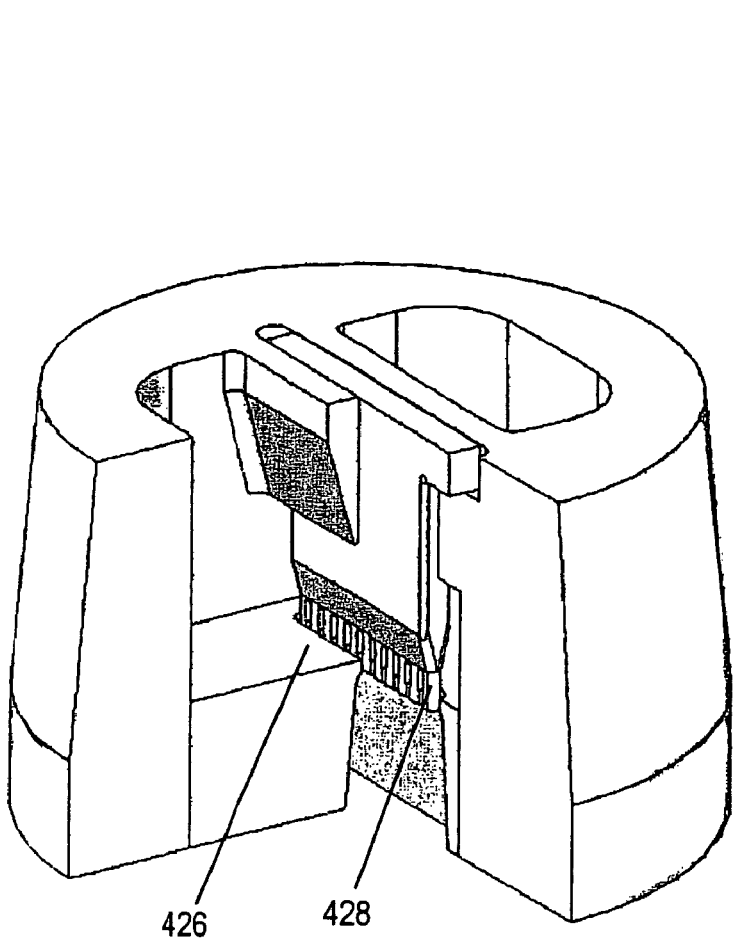
FIG. 7 is a diagram showing a perspective view of an exemplary die assembly, with a quarter of the die assembly removed to allow inspection of its internal design.

FIG. 7 shows the die assembly 424, according to one exemplary, wherein a quarter of the die assembly has been cut away to expose its internal configuration. As can be seen in FIG. 7, the die assembly 424 includes the plate 426 and the mandrel 428, wherein the mandrel 428 is fixed relative to the plate 426.

FIG. 8A shows the die assembly 424, according to one exemplary embodiment. As shown in FIG. 8A, the die assembly 424 includes the plate 426 and the mandrel 428. In one exemplary embodiment, the mandrel 428 is fixed relative to the plate 426. By extending through the opening 430 in the plate 426, the mandrel 428 forms the opening 432 between one side of the mandrel 428 and the plate 426. By extending through the opening 430 in the plate 426, the mandrel 428 also forms the opening 434 between an opposite side of the mandrel 428 and the plate 426. These openings 432, 434 allow the two separate streams of the flowing non-aluminum metal or alloy to form the top half 410 and the bottom half 412, respectively, of the micro-channel tube 402 (see FIG. 5). The mandrel 428 includes the weld chambers 438 into which the two separate streams of the flowing non-aluminum metal or alloy flow to form the continuous internal walls 440, thereby connecting the top half 410 and the bottom half 412 to form the unitary micro-channel tube 402. A favorable bearing length and weld-chamber size and geometry are selected to produce sufficient stress and metal flow into the weld chambers 438 to produce good solid state welds in the internal walls 440.

As shown in FIG. 8A, an edge 480 of the plate 426 is shaped such that a deformation zone of the die assembly 424, i.e., between the plate 426 and the mandrel 428, is of a flat or shear-edge design. FIG. 8B shows the die assembly 424, according to one exemplary embodiment, which is similar to the exemplary embodiment shown in FIG. 8A. In the die assembly shown in FIG. 8B, however, an edge 482 of the plate 426 is shaped such that a deformation zone of the die assembly 424, i.e., between the plate 426 and the mandrel 428, resembles the design approach of a shaped die. The flat/shear-edge die design are generally used without a lubricant. Conversely, the shaped die design is typically used with a lubricant for metal extrusion when the billets 404, 406 are formed of a material having a high flow stress. Thus, one configuration and geometry of the die assembly 424 may be more suitable than another depending on the material being extruded through the die assembly 424.

In the die assembly 424 (e.g., the die assembly 424 shown in FIG. 8A and/or FIG. 8B), the mandrel 428 is an alloy steel, super alloy or other suitable material, coated with a hard thin-film coating deposited by chemical vapor deposition (CVD) or physical vapor deposition (PVD) to provide improved wear characteristics. In one exemplary embodiment, the components of the die assembly 424, as well as other components of the apparatus 400, are made from super alloys, which overcome the problems associated with using hot-work tool steel. For example, the super alloys being used provide greater strength at high temperatures than hot-work steel. In one exemplary embodiment, the critical wear components of the die assembly 424 (i.e., the plate 426 and the mandrel 428) are made from a super alloy and coated with an $Al_2O_3$ coating, which is deposited by CVD and has a service temperature of approximately 800° C. One of ordinary skill in the art will appreciate that other hard coatings (e.g., a diamond-like carbon coating) could be used to improve the wear resistance of the die assembly 424 components.

Because two separate billets 404, 406 are used, the extruded metal does not need to divide into separate flow streams as the two flow streams are already present in the process from the container 408 to the die assembly 424. Consequently, deformation work is reduced and undesirable stress on the mandrel 428 is reduced or otherwise eliminated. Furthermore, because the billets 404, 406 have a shape (e.g., a substantially rectangular shape) that is closer in shape to the final extrusion profile (of the micro-channel tube 402) than a typical round billet, the overall extrusion work is further reduced. In this manner, the apparatus can produce a multi-cavity, hollow profile (i.e., the multi-channel tube 402) from direct hot extrusion of the billets 404, 406 in a single operation.

In one exemplary embodiment, the apparatus 400 interfaces with or otherwise incorporates a machine, such as a servo-hydraulic MTS Systems Corporation machine having a 250 kN/56,000 lb. load capacity, to provide the extrusion force to the apparatus 400. The machine includes a grip 442 that holds the ram 420, wherein the machine can drive the dual stem 422 of the ram 420 against the billets 404, 406 to force the billets 404, 406 into the chamber 408 and through the die assembly 424. The machine can also include a grip 444 for supporting the remaining portions of the apparatus 400 (e.g., the dual-chamber container 408, the die holder 418 and the die assembly 424). Heat exchangers/coolers (not shown) can be used to isolate the heat generated by the apparatus 400 from the machine.

As the micro-channel tube 402 exits the apparatus 400, it can be air or water cooled. In one exemplary embodiment, the micro-channel tube 402 has a length of approximately 640 mm from 50 mm of extruded billet. One of ordinary skill in the art will appreciate that a length of the extruded micro-channel tube 402 can be varied by selecting appropriately sized billets and/or continuing to weld or fuse additional billets to the initial billets as the initial billets are consumed during the extrusion process. Provisions can be made, as known in the art, to safely handle the hot micro-channel tube 402 as it exits the apparatus 400.

Figure 9:
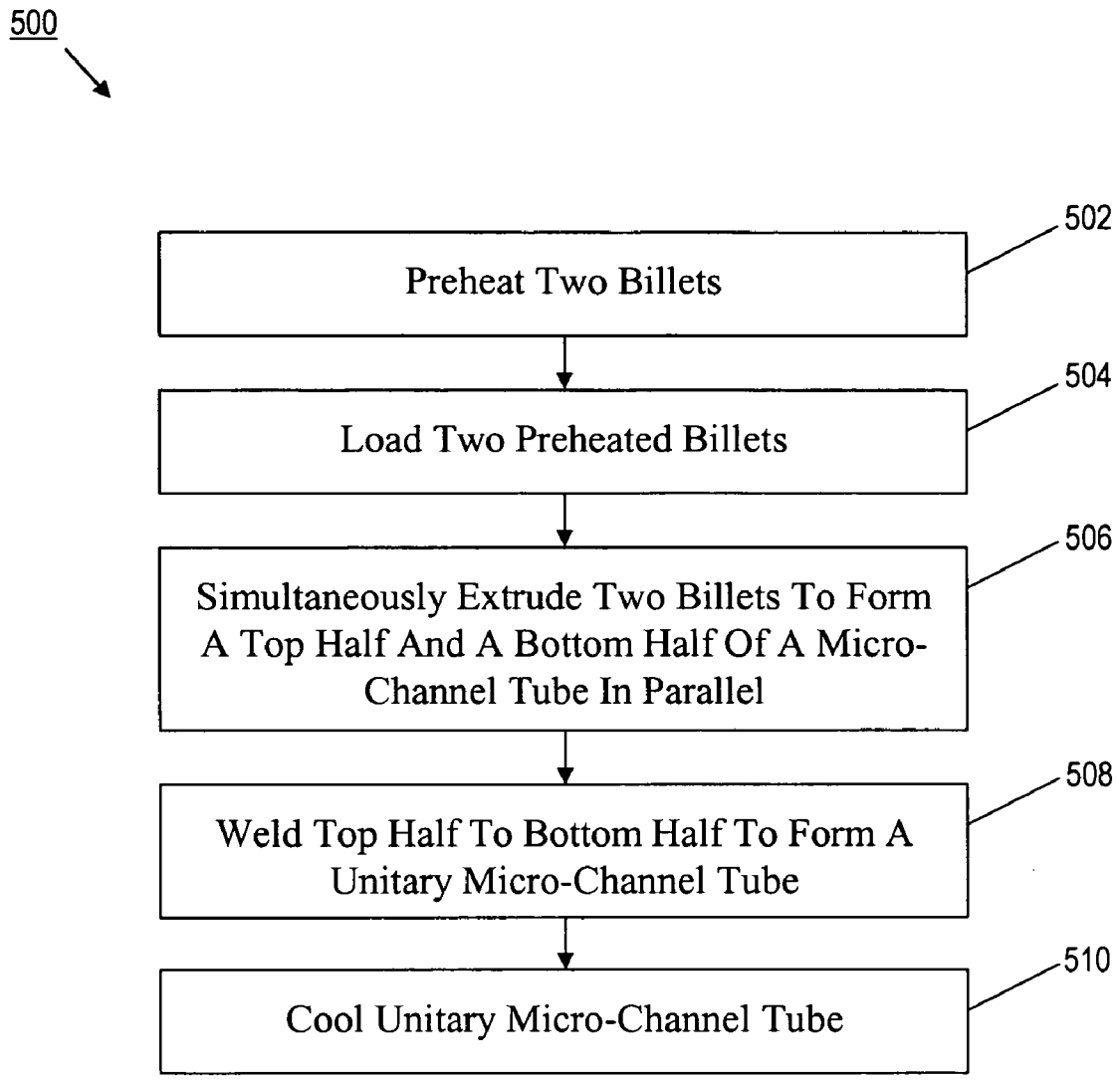
FIG. 9 is a flowchart showing a method, according to one exemplary embodiment, for producing micro-channel tubes from a non-aluminum metal or alloy.

In one exemplary embodiment shown in FIG. 9, a method 500 of producing a micro-channel tube from a non-aluminum metal or alloy (e.g., copper), using a modified hot extrusion process, is provided. The method 500 involves pre-heating two billets in step 502. The billets can be heated using any suitable means, such as a furnace, induction heater or infrared heater.

In one exemplary embodiment, the two billets are made of copper or a copper alloy. In one exemplary embodiment, each of the two billets is made of a different material, such that the resulting extruded product or part is comprised of the different materials. In one exemplary embodiment, a shape of the billets is similar to a shape of the intermediate product or part being extruded (i.e., the top half or the bottom half) and/or a shape of the final product or part being extruded (i.e., the unitary micro-channel tube). In one exemplary embodiment, the billets have a substantially rectangular (in cross-section) shape. In one exemplary embodiment, at least one of the billets is solid.

The preheated billets are then loaded for extrusion in step 504. In one exemplary embodiment, the billets are loaded into a dual chamber container of a direct hot extrusion apparatus. One of ordinary skill in the art will appreciate that the billets can be loaded into the apparatus using any suitable fixture or device.

Once loaded, the billets are simultaneously extruded in step 506 to form a top half and a bottom half of a micro-channel tube. Then, the top half and the bottom half are welded together in the weld chambers 438 of the mandrel 428 to form a unitary micro-channel tube in step 508. It is important that sufficient new metal surface area is generated during deformation in the die assembly 424, such that the solid-state welds can readily form as a result of the high temperature and existing pressure in the die assembly 424. In one exemplary embodiment, the top and bottom halves are welded together within the extrusion apparatus, such that the unitary micro-channel tube is extruded from the apparatus. In this manner, the method can produce a multi-cavity, hollow profile (i.e., the multi-channel tube) from direct hot extrusion of the solid billets in a single operation.

As the micro-channel tube is extruded, the micro-channel tube is cooled in step 510. In one exemplary embodiment, the unitary micro-channel tube is air or water cooled, for example, using a water bath, agitated water bath, water spray, air/water spray, etc. One of ordinary skill in the art will appreciate that the extruded micro-channel tube can be cooled and subsequently handled/processed in any suitable manner.

In process modeling for the exemplary embodiments described herein, flow stress data from hot compression testing were taken from the literature for Oxygen Free Electronic (OFE) copper and these data are summarized below in Table 1. The values in Table 1 are useful for describing the exemplary embodiments. It is also worth noting (for comparison purposes) that extreme conditions of high strain rate and low temperature for an extrusion process using an aluminum alloy can result in flow stresses in excess of 50 MPa.

TABLE 1

Steady-state flow stress values for OFE copper.

| Strain | Flow stress, MPa (ksi) Temperature | |
|---|---|---|
| rate ($s^{-1}$) | 600° C. | 850° C. |
| 0.1 | 60 (8.7) | 25 (3.6) |
| 1 | 85 (12.3) | 35 (5.1) |
| 3 | 100 (14.5) | 43 (6.2) |
| 10 | 110 (15.9) | 50 (7.2) |

Using the flow stress data, a series of computerized (e.g., finite element (FE) or finite volume (FV)) analyses can be performed to facilitate and/or otherwise improve the apparatus for and/or method of providing the copper micro-channel tube. For example, FE/FV analysis can be used to determine die geometry and configuration, i.e., shear die versus shape die configuration (c.f., FIGS. 8A and 8B), bearing length, weld chamber geometry, etc. The FE/FV analysis can also be used to determine die stresses such that the plate and mandrel (of a die assembly) are suitably designed. Furthermore, the FE/FV analysis can be used to determine a temperature range and strain rate of extrusion for some initial conditions. Further still, the FE/FV analysis can be used to determine maximum extrusion loads such that a billet and resulting micro-channel tube can be suitably sized for extrusion in an exemplary apparatus (e.g., the apparatus 400 interfaced with an MTS Systems Corporation machine having a 250 kN/56,000 lb. load capacity).

The suitability of a particular machine such as the 250 kN/56,000 lb. MTS machine for use with the exemplary apparatus and/or method can be verified using extrusion formulae. The extrusion pressure (extrusion force divided by the total container area) can be divided into three distinct components. These encompass ideal work, friction work and redundant work, Equations 1, 2 and 3, respectively. Sticking friction is assumed in Equation 2.

$$u_{ideal} = \overline{Y}_f \ln R \tag{1}$$

$$u_{friction} = \frac{\overline{Y}_f A_s}{\sqrt{3}\, A_b} \tag{2}$$

$$u_{redundant} = \overline{Y}_f \ln R(\phi - 1) \tag{3}$$

where $u_i$ represents the work per volume for each component, $\overline{Y}_f$ is the flow stress, R is the extrusion ratio, $A_s$ is the surface area of the billets in contact with the container, $A_b$ is the total cross-sectional area of the billets (dictated by the container)

and $\phi$ is the redundant work factor. Equations 1, 2 and 3 can be summed, and multiplied by $A_b$ to estimate the maximum force required for extrusion.

$$\text{Extrusion Force} = \bar{Y}_f A_b \left[ \phi \ln R + \frac{A_s}{\sqrt{3}\, A_b} \right] \tag{4}$$

Equation 4 was used to evaluate the extrusion force to extrude the tube shown in FIG. 6 assuming the conservative parameters set forth below in Table 2. The estimated maximum force using Equation 4 and the parameters set forth in Table 2 is 246 kN (55,296 lbs), which is within the maximum force available using the 250 kN/56,000 lb. MTS machine, which indicates that the MTS machine could suffice for use with the exemplary apparatus and/or method. One of ordinary skill in the art will appreciate that further refinement could be achieved using the FE/FV analysis to predict additional loads and allow for a more comprehensive optimization of the parameters.

TABLE 2

Preliminary extrusion parameters used to demonstrate feasibility of process.

| | |
|---|---|
| billet width (mm) | 16 |
| billet thickness (mm) | 6 |
| billet length (mm) | 63.5 |
| flow stress (MPa) | 55 |
| redundant work factor, $\phi$ | 3 |
| tube cross-sectional area ($mm^2$) | 17.32 |

The general inventive concept, including the exemplary embodiments described herein, represents a simple and versatile approach to producing a non-aluminum metal or alloy micro-channel tube (or other multi-cavity profiles that could be used in other heat transfer applications) in one operation, thereby allowing such micro-channel tube to be used in the commercial and residential HVAC industries.

The above description of specific embodiments has been given by way of example. From the disclosure given, those skilled in the art will not only understand the general inventive concept and its attendant advantages, but will also find apparent various changes and modifications to the structures and methods disclosed. For example, although a multi-chamber container has been disclosed herein as having two chambers, the general inventive concept is readily extendible to a multi-chamber container having more than two chambers. Accordingly, the general inventive concept encompasses an apparatus and/or a method for extruding simultaneously two or more billets (e.g., non-aluminum metal or alloy billets) to produce a micro-channel tube or other hollow profile that would otherwise not be able to be produced with conventional hollow-die extrusion techniques. It is sought, therefore, to cover all such changes and modifications as fall within the spirit and scope of the general inventive concept, as defined by the appended claims, and equivalents thereof.

The invention claimed is:

1. An apparatus for extruding at least one part from a plurality of billets, the apparatus comprising:

an extrusion container having a first chamber and a second chamber for receiving a first billet and a second billet, respectively; and a die assembly including a plate and a mandrel, wherein the apparatus is operable to simultaneously force a first billet and a second billet into the die assembly to extrude a first part and a second part corresponding to the first billet and the second billet, respectively;

wherein at least one of the first billet and the second billet is formed of copper or a copper alloy;

wherein the extrusion container and the die assembly are preheated to a predetermined temperature;

wherein the mandrel includes at least one weld chamber, the at least one weld chamber being operable to receive simultaneously a metal stream corresponding to the first billet and a metal stream corresponding to the second billet to join the first part and the second part within the die assembly to form a third part;

wherein the third part is a multi-channel tube having a plurality of channels;

wherein the first part is a first portion of the multi-channel tube;

wherein the second part is a second portion of the multi-channel tube; and wherein the first and second portions are forced together in the weld chamber to produce solid-state welds to form continuous internal walls of the multi-channel tube, each of said continuous internal walls separating a pair of adjacent channels of the multi-channel tube.

2. The apparatus of claim 1, further comprising a ram including a dual stem, wherein the dual stem is operable to simultaneously force the first billet and the second billet into the die assembly.

3. The apparatus of claim 1, wherein the apparatus extrudes the first part and the second part by direct extrusion.

4. The apparatus of claim 1, wherein the first billet and the second billet are formed of different materials, such that the extruded first part and the extruded second part are formed from the different materials.

5. The apparatus of claim 1, wherein the predetermined temperature is in the range of 550° C. to 1000° C.

6. A method of extruding at least one part from a plurality of billets, the method comprising:

loading a first billet and a second billet in an extrusion device including a die assembly, the die assembly including a plate and a mandrel;

preheating the extrusion device to a predetermined temperature;

simultaneously extruding the first billet and the second billet through the die assembly to form a first part and a second part corresponding to the first billet and the second billet, respectively; and joining the first part and the second part in at least one weld chamber within the die assembly to form a third part, wherein at least one of the first billet and the second billet is formed of copper or a copper alloy;

wherein the third part is a multi-channel tube having a plurality of channels;

wherein the first part is a first portion of the multi-channel tube;

wherein the second part is a second portion of the multi-channel tube; and wherein in the step of joining the first part and the second part within the die assembly, the first and second portions are forced together in the weld chamber to produce solid-state welds to form continuous internal walls of the multi-channel tube, each of said continuous internal walls separating a pair of adjacent channels of the multi-channel tube.

7. The method of claim 6, further comprising preheating the first billet and the second billet prior to loading the first billet and the second billet in the extrusion device.

8. The method of claim 6, wherein at least one of the first billet and the second billet has a profile substantially similar to a profile of the third part.

9. The method of claim 6, wherein the first billet has a profile substantially similar to a profile of the first part; and wherein the second billet has a profile substantially similar to a profile of the second part.

10. The method of claim 6, wherein the first part and the second part are extruded by direct extrusion.

11. The method of claim 6, wherein the first billet and the second billet are formed of a non-aluminum metal or alloy.

12. The method of claim 11, wherein the non-aluminum metal or alloy is one of copper or a copper alloy.

13. The method of claim 6, wherein the first billet and the second billet are formed of different materials, such that the extruded first part and the extruded second part are formed from the different materials.

14. The method of claim 6, wherein at least one of the first billet and the second billet has a substantially rectangular shape.

15. The method of claim 6, wherein the predetermined temperature is in the range of 550° C. to 1000° C.

* * * * *